US011453461B2

(12) United States Patent
Thomas

(10) Patent No.: US 11,453,461 B2
(45) Date of Patent: Sep. 27, 2022

(54) EXPANSION DECK SYSTEM FOR VESSELS

(71) Applicant: Michael Thomas, Deland, FL (US)

(72) Inventor: Michael Thomas, Deland, FL (US)

( * ) Notice: Subject to any disclaimer, the term of this patent is extended or adjusted under 35 U.S.C. 154(b) by 92 days.

(21) Appl. No.: 17/086,166

(22) Filed: Oct. 30, 2020

(65) Prior Publication Data

US 2021/0047001 A1 Feb. 18, 2021

Related U.S. Application Data

(63) Continuation-in-part of application No. 16/352,439, filed on Mar. 13, 2019, now Pat. No. 10,843,771.

(60) Provisional application No. 62/642,258, filed on Mar. 13, 2018, provisional application No. 62/942,416, filed on Dec. 2, 2019.

(51) Int. Cl.

| | |
|---|---|
| ***B63B 3/48*** | (2006.01) |
| ***B63B 1/12*** | (2006.01) |
| ***B63B 35/38*** | (2006.01) |

(52) U.S. Cl.

CPC ..... *B63B 3/48* (2013.01); *B63B 1/121* (2013.01); *B63B 35/38* (2013.01); *B63B 2003/485* (2013.01)

(58) Field of Classification Search

CPC .... B63B 3/00; B63B 3/48; B63B 1/00; B63B 1/121; B63B 35/00; B63B 35/38; B63B 2003/485; B63B 21/00; B63B 21/64

USPC ..... 114/353, 354, 364

See application file for complete search history.

(56) References Cited

U.S. PATENT DOCUMENTS

| | | | | |
|---|---|---|---|---|
| 4,085,473 | A | 4/1978 | Franklin | |
| 5,915,328 | A | 6/1999 | Rowan | |
| 7,004,101 | B1 | 2/2006 | Mardikian | |
| 8,752,499 | B2 | 6/2014 | Basto et al. | |
| 9,067,646 | B2 | 6/2015 | Admire | |
| 9,156,526 | B2 * | 10/2015 | Handley | B63B 35/34 |
| 10,717,497 | B2 * | 7/2020 | Yoder | B63B 35/34 |
| 2015/0096486 | A1 | 4/2015 | Admire | |

* cited by examiner

*Primary Examiner* — Lars A Olson

(74) *Attorney, Agent, or Firm* — Jason T. Daniel, Esq.; Daniel Law Offices, P.A.

(57) ABSTRACT

An expansion deck system for vessels includes a frame assembly for positioning between a stationary floor of a vessel and a plurality of pontoons of the vessel. The frame assembly including a first side with a first elongated opening, and a second side with a second elongated opening. One or more sliding deck members are telescopically connected to the frame assembly by one or more sliding rails and transition between a retracted position and an extended position. In the retracted position the one or more sliding deck members are positioned between the floor and pontoons of the vessel, and in the extended position the one or more sliding deck members are positioned alongside the frame assembly.

20 Claims, 7 Drawing Sheets

EXPANSION DECK SYSTEM FOR VESSELS

CROSS-REFERENCE TO RELATED APPLICATIONS

This application claims the benefit of U.S. Application Ser. No. 62/942,416, filed on Dec. 2, 2019, and is a continuation in part to copending U.S. application Ser. No. 16/352,439 having a priority date of Mar. 13, 2019, the contents of each of which are incorporated herein by reference.

TECHNICAL FIELD

The present invention relates generally to boating, and more particularly to an expansion deck system for a vessel.

BACKGROUND

The statements in this section merely provide background information related to the present disclosure and may not constitute prior art.

Conventional pontoon boats are constructed from two or more elongated pontoons having a generally flat deck that is supported along the top ends thereof. In this configuration, most of the seating is arranged along the outer periphery of the deck behind a safety railing, so as to maximize available space along the interior of the vessel.

Although this configuration works well for simply riding in the vessel, it does not lend itself for activities such as fishing or diving, for example, wherein a user needs to be able to walk along the outermost periphery of the vessel. Moreover, because the width of a boat is limited to approximately 8 foot in order to comply with Department of Transportation (DOT) regulations for highway towing, users have been left with few options for using such vessels for expanded activities. Although one prior attempt to provide an auxiliary deck is described in U.S. Pat. No. 9,067,646, to Admire, the proposed system's use of diagonally oriented bracing and limited support structure represent a significant tripping hazard for users and an unstable platform in the water.

Accordingly, it would be beneficial to provide an expansion deck system for a vessel such as a pontoon boat, for example, that can provide a user with an unobstructed expanded deck beyond the above noted seating and railing, that can be used for any number of different activities while remaining within the DOT regulations and not suffering from the above noted drawbacks.

SUMMARY OF THE INVENTION

The present invention is directed to an expansion deck system for vessels. One embodiment of the present invention can include a frame assembly for positioning between a stationary floor of a vessel and a plurality of pontoons of the vessel. The frame assembly can include a first side with a first elongated opening, and a second side with a second elongated opening. In one embodiment, one or more sliding deck members can be connected to the frame assembly and can include functionality for moving between a retracted position and an extended position.

In one embodiment, each of the sliding deck members can move laterally so as to be selectively positioned within the frame assembly in the retracted position, and alongside the frame assembly when in the extended position.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1A:
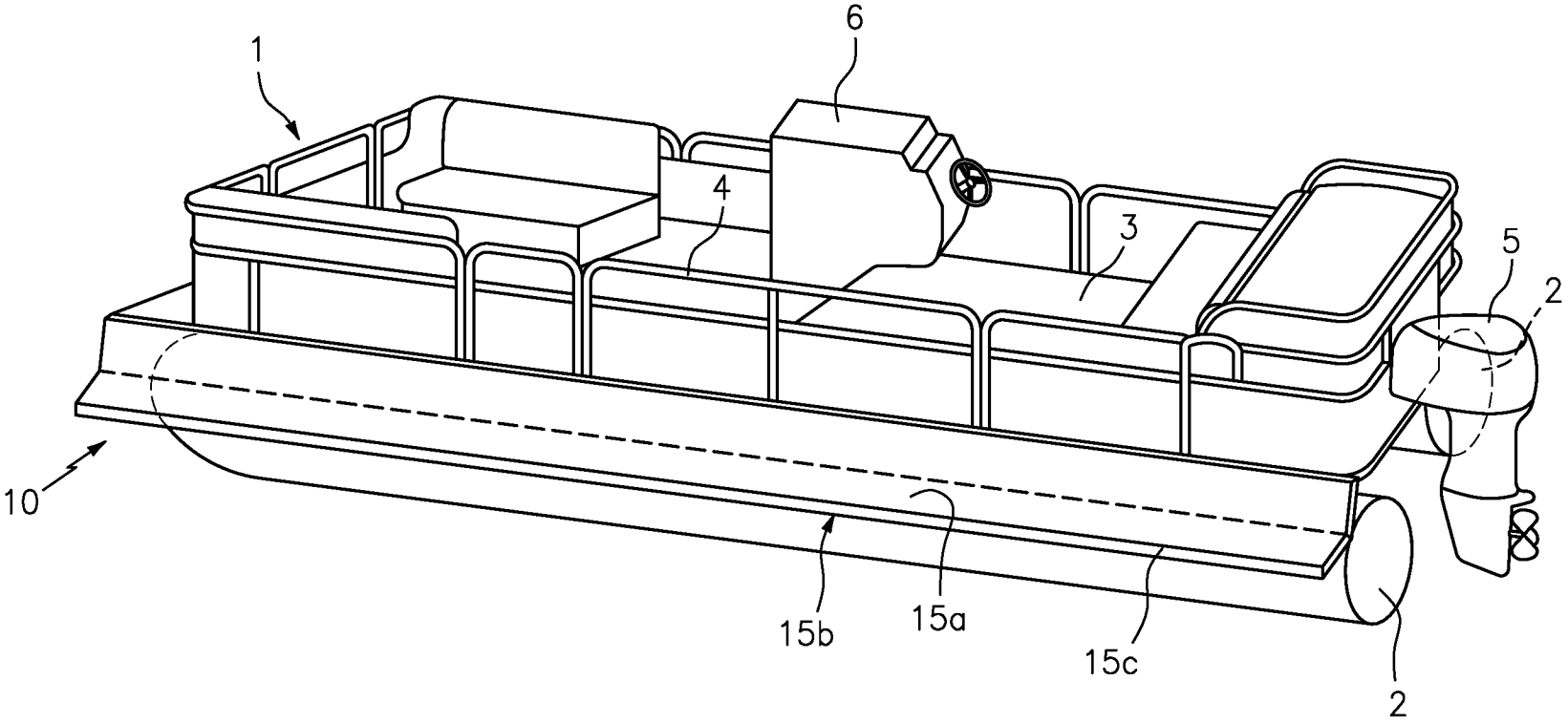
FIG. 1A is a perspective view of a vessel with the expansion deck system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Although illustrated and described as a pontoon-style boat, this is for illustrative purposes only, as the innovative concepts can be included in the design of a "hulled" vessel using the same methodology described below wherein the open sides of the frame assembly are aligned with openings on the hull.

Definitions

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "removably secured" and derivatives thereof shall be used to describe a situation wherein two or more objects are joined together in a non-permanent manner so as to allow the same objects to be repeatedly joined and separated. This can be accomplished through the use of any number of commercially available connectors such as opposing strips of hook and loop material, magnets, and/or compression fittings such as locking pins, clamps, nut/bolts, tethers (e.g., zip ties), snaps and buttons, for example.

As described herein, the term "permanently secured" shall be used to describe a situation wherein two or more objects are joined together in a manner so as to prevent the same objects from being separated. Several nonlimiting examples include various adhesives (e.g., glue or resin) permanent mounting hardware (e.g., rivets), and welds, for example.

FIGS. 1-4C illustrate one embodiment of an expansion deck system for vessels 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Figure 1B:
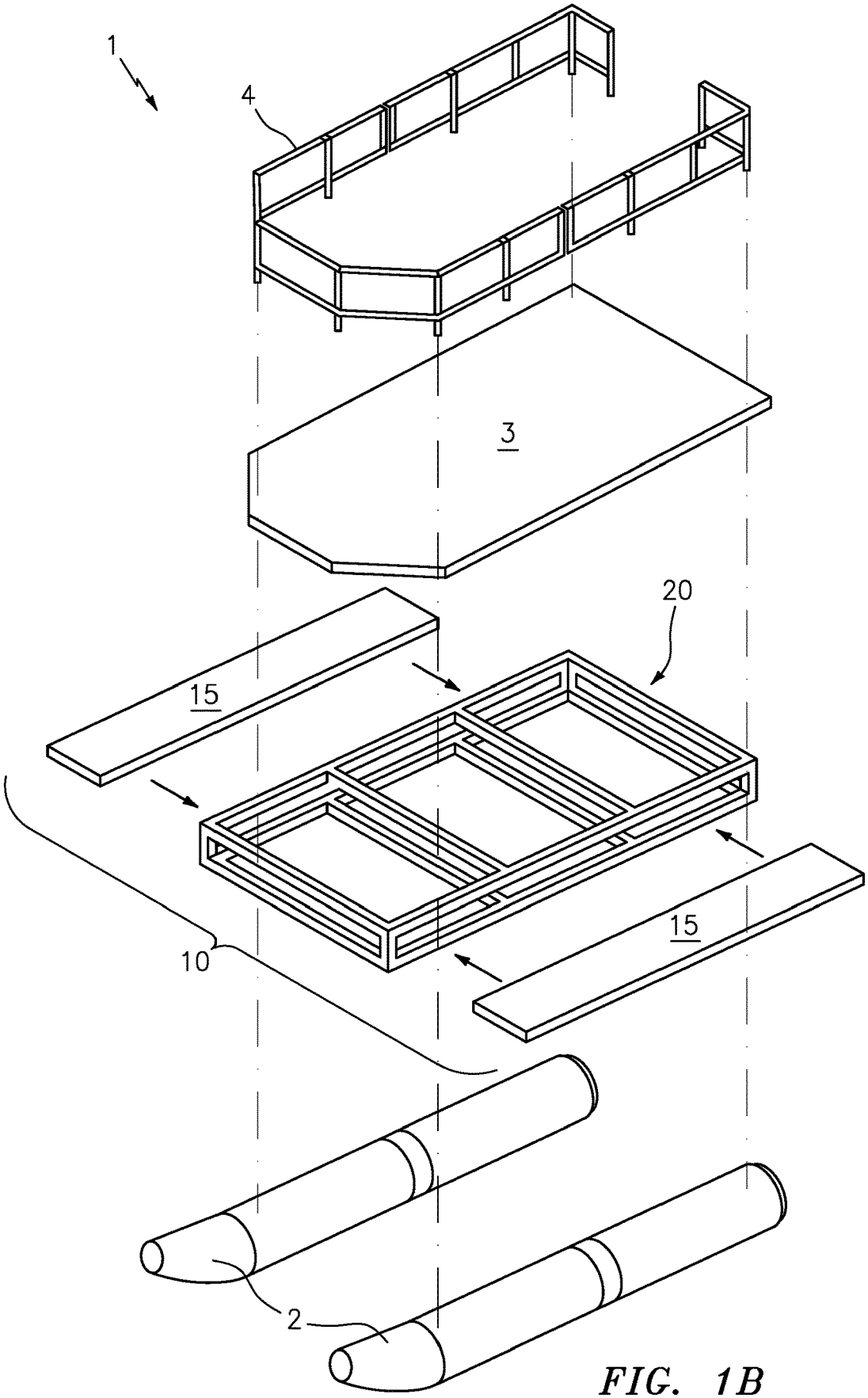
FIG. 1B is an exploded parts view of the vessel of FIG. 1, in accordance with one embodiment of the invention.

FIGS. 1A and 1B illustrates a vessel 1 having an expansion deck system 10 in accordance with one embodiment. As shown, the exemplary vessel can include a hull or a plurality of pontoon floats 2, a stationary vessel floor 3, a safety rail assembly 4, a motor 5, a control console 6, and an expansion deck system 10 having one or more sliding deck members 15 that are positioned between the pontoons and floor. As described herein, the inventive system can be incorporated into the design and construction of a new vessel having the above noted components, and/or can be provided as an expansion system/kit for retrofitting an existing vessel with one or more of the sliding deck members.

In one embodiment, each sliding deck member 15 can include an elongated generally rectangular-shaped main body having a top surface 15*a*, a bottom surface 15*b*, an outside edge 15*c* and an inside edge 15*d*. Each deck member 11 can be constructed to include any number of different lengths, widths and thicknesses, and can be provided along the vessel as one continuous piece per side (e.g., port, starboard, bow, stern), or as a plurality of individual segments that are joined serially to comprise different lengths along any side of the vessel 1.

In the preferred embodiment, each sliding deck member can be constructed from gelcoat-covered Styrofoam having an internally located aluminum frame for structural support. Such a construction providing a lightweight, waterproof panel with excellent durability and resistance to sun rot. Of course, any number of other materials that are suitable for prolonged exposure to water and that are relatively strong and stiff for their weight are also contemplated. Several nonlimiting examples include, but are not limited to various types of wood, plastics/polymers and/or various composite materials, for example.

Figure 2:
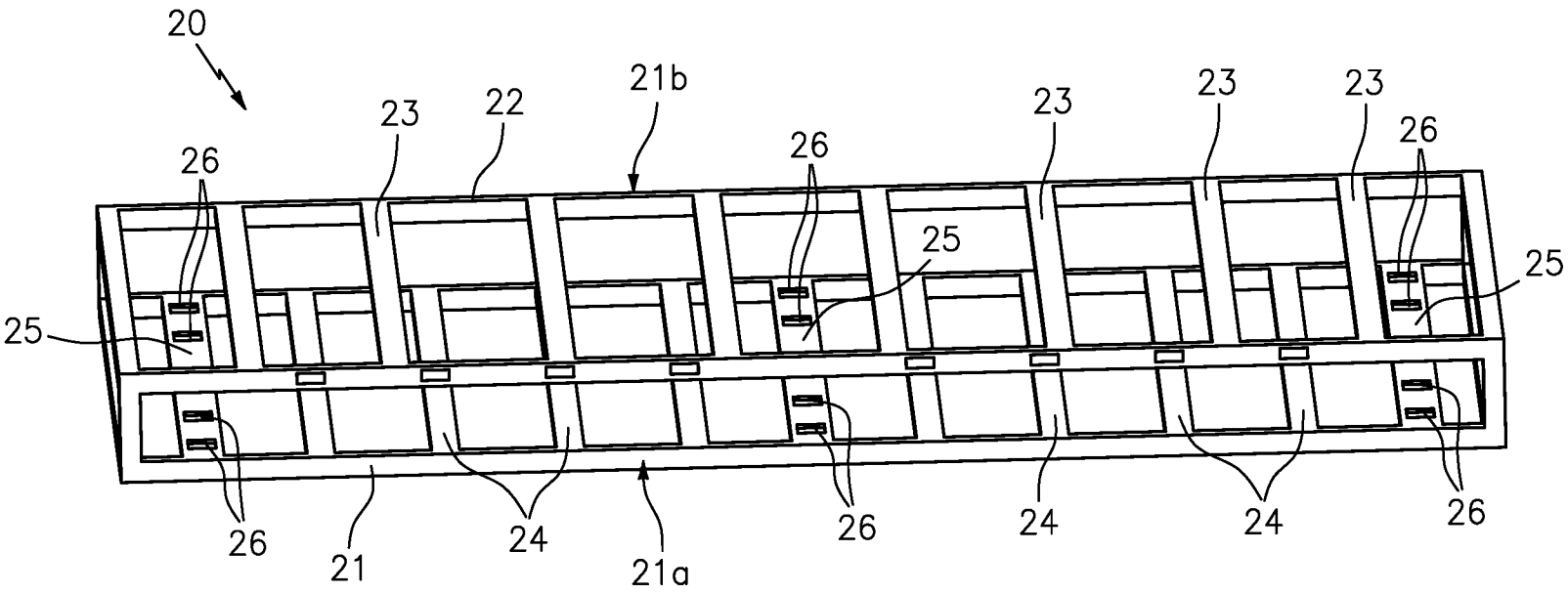
FIG. 2 is a perspective view of the frame assembly of the expansion deck system, in accordance with one embodiment of the invention.

FIG. 2 illustrates one embodiment of the frame assembly 20, that includes a pair of elongated side frame members 21 and 22 that are arranged parallel to each other. Each of the frame members defining a central opening 21*a* and 21*b*, respectively, along their lengths. Frame members 21 and 22 can be connected along their top and bottom ends by a plurality of upper frame members 23 and lower frame members 24, to form a hollow, generally rectangular-shaped frame. In the preferred embodiment, each of the frame members 21-24 can be constructed from aluminum beams that are permanently joined together via brackets, welding or the like.

In one embodiment, a plurality of sliding rails 25 can be positioned along the frame assembly so as to extend between the side rails 21 and 22. In the illustrated embodiment, each of the sliding rails can include an elongated track having multiple sliding attachment blocks 26 secured thereon. The attachment blocks including bearings and other components to enable smooth movement along the length of the rail.

One example of a sliding rail 25 for use herein includes the Heavy Duty Linear Bearing Slide Rail unit that is commercially available by Firgelli® Linear slides. Of course, any number of other devices capable of engaging the sliding floor members and transitioning the same between an open and closed orientation are also contemplated. For example, some embodiments may utilize a telescopic-style sliding system such as the commercially available TRUCK-SLIDE XT1200 by Highway Products, INC., for example. Such a feature enabling larger width sliding deck members to be used.

Although described as including a particular construction material, number of frame members and/or a particular shape, this is for illustrative purposes only. To this end, the frame assembly 20 can be formed from any number of different frame materials such as steel, wood and/or composites, for example, and can include any number of different individual frame members which can be arranged in any number of different orientations to form a frame having any number of different shapes and sizes. Additionally, other embodiments are contemplated wherein the sliding rail is positioned beneath or above the frame assembly.

Figure 3A:
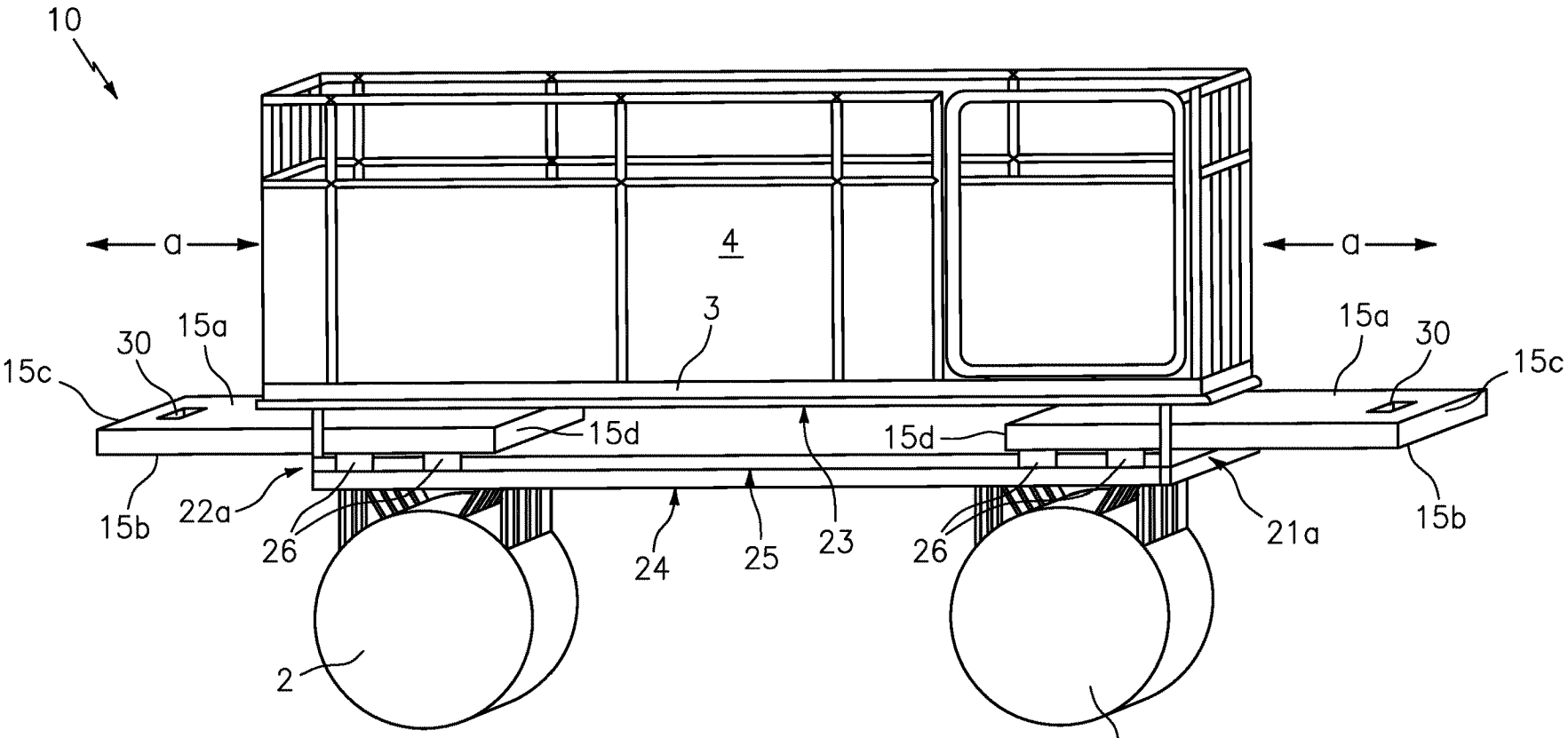
FIG. 3A is a front view of a vessel with the expansion deck system in the extended position, in accordance with one embodiment of the invention.
Figure 3B:
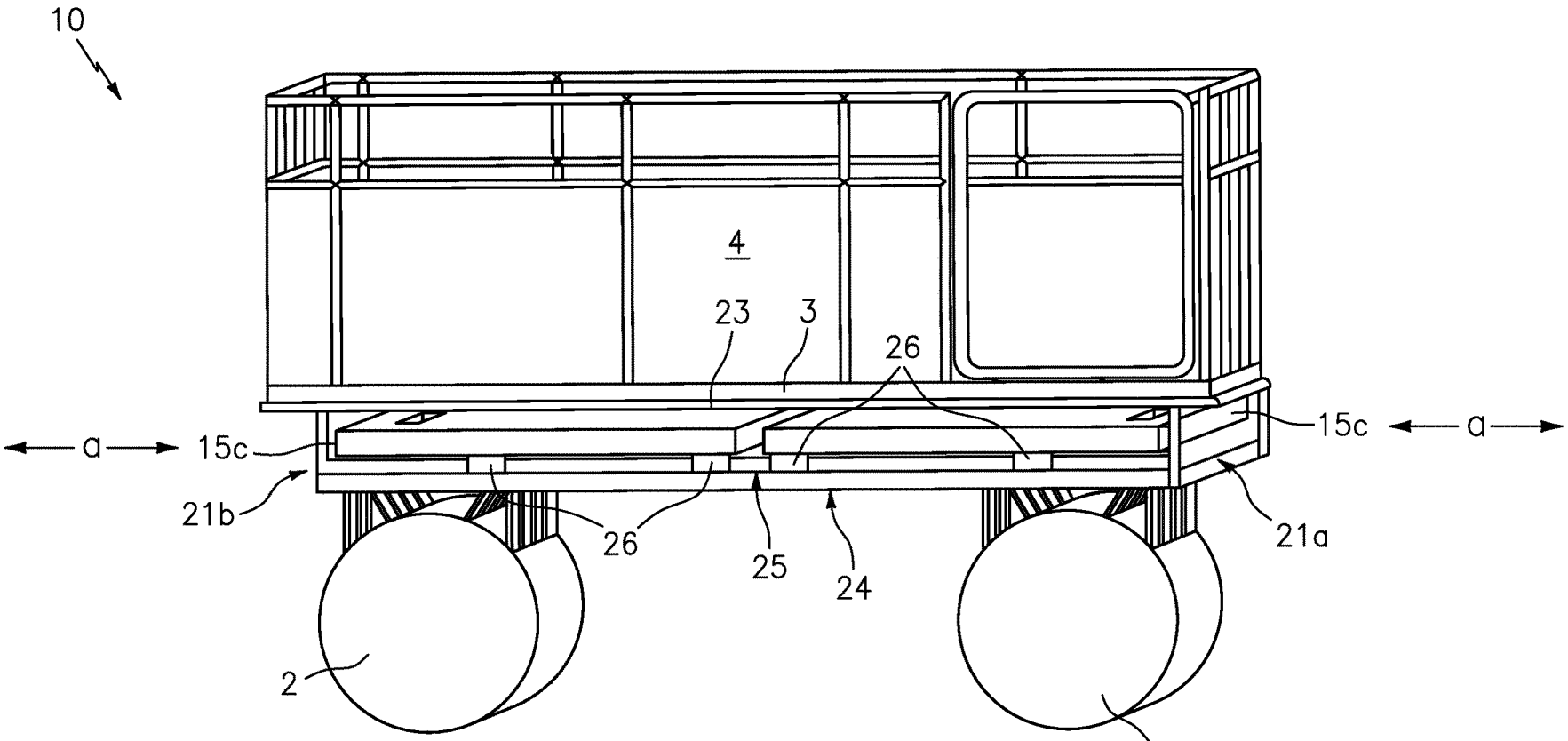
FIG. 3B is a front view of a vessel with the expansion deck system in the retracted position, in accordance with one embodiment of the invention.

As shown at FIGS. 3A and 3B, the bottom and/or side edge of each sliding deck member 15*b* can be secured onto one or more of the sliding blocks 26 on each of the plurality of sliding rails via mounting hardware such as screws or bolts, for example. When so positioned, each sliding deck can move linearly (see arrow A), between the extended position shown at FIG. 3A and the retracted position shown at FIG. 3B. To this end, any number of hand rails, handles 30 and the like can be positioned along the sliding members to enable a user to push and pull the members between the illustrated extended and retracted positions manually.

Although not specifically illustrated, any number of clamps, brakes or other such connectors can be provided along the frame assembly to allow a user to physically secure the sliding frame(s) in a desired position. Moreover, any number of support braces and/or slide extension arms can be provided anywhere along the frame assembly and/or the sliding deck members as needed to prevent sagging, and to ensure smooth level movement of the sliding deck members.

Figure 4A:
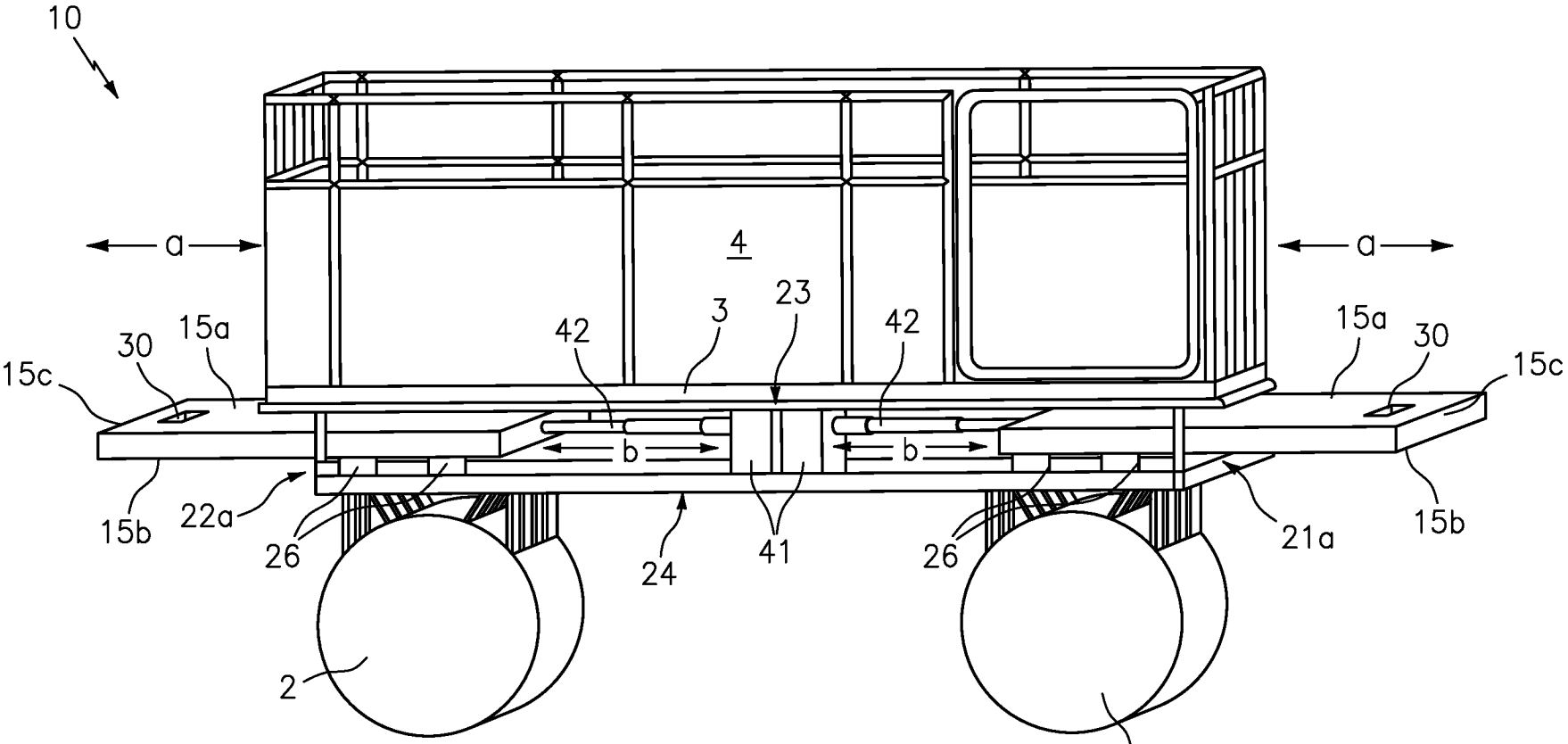
FIG. 4A is a front view of a vessel with the expansion deck system in the extended position, in accordance with one embodiment of the invention.
Figure 4B:
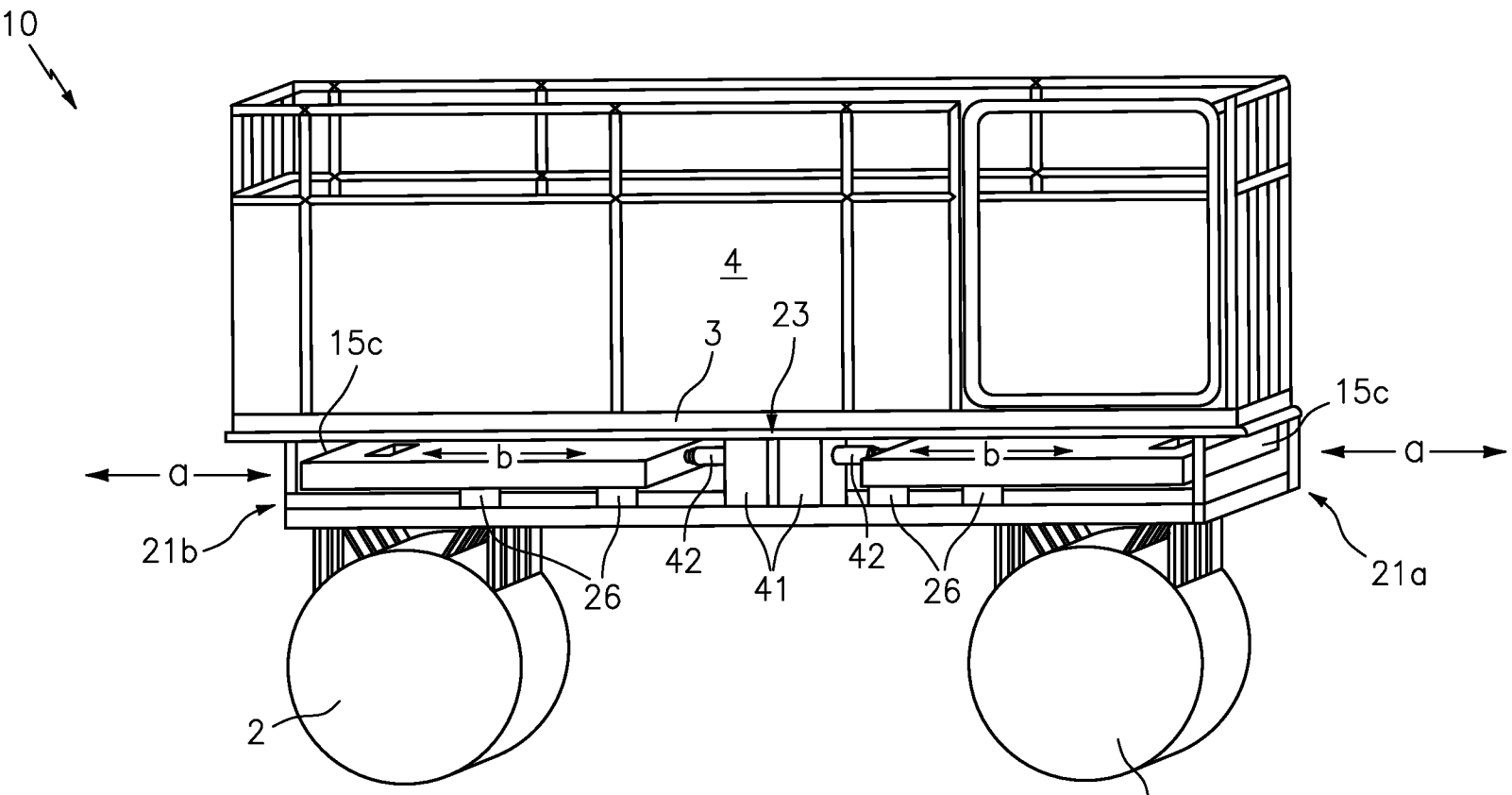
FIG. 4B is a front view of a vessel with the expansion deck system in the retracted position, in accordance with one embodiment of the invention.

As shown at FIG. 4, one embodiment of the expansion deck system 10 includes a system for automatically transitioning the sliding deck members 15 between the extended and retracted positions. The system including a control switch that can be located in the control console, for example, and hardware for connecting to the vessels onboard battery.

In the illustrated embodiment, the system includes two linear motors 41 that are positioned centrally along the frame assembly. Each of the motors including an extension arm 42 that is connected to one of the deck members 15 along a distal end, and the motor 41 at a proximal end.

As shown by arrow b, the motors 41 can selectively push and pull the sliding deck members 15 between the extended and retracted positions, thus eliminating the need for a user to manually push and pull the same. Moreover, the motors can include an internal braking mechanism for allowing the user to stop the movement of the deck members anywhere along their path. Such a feature functioning to lock the deck members in any desirable position.

As described herein, a linear motor can include, comprise or consist of any device capable of imparting controlled linear movement onto the sliding deck members. Several nonlimiting examples include linear actuators such as the model K2G10-24V-BR-18, 600 lb rated Linear Actuator that is commercially available from GRAINGER, for example, and/or a hydraulic cylinder system. In such an embodiment, the hydraulic cylinders can comprise a self-contained pump and reservoir; however other embodiments are contemplated where the cylinder is connected to a remotely located pump and reservoir via hydraulic lines.

Of course, the inventive concepts are not limited to the use of a linear actuator/hydraulic cylinder system, as any number of other systems capable of moving the sliding deck members between the extended and retracted positions are also contemplated. Several nonlimiting examples include pneumatic actuators, twisted and coiled polymer actuators, piezoelectric actuators, and/or motorized systems employing ropes and pulleys, for example.

Although illustrated in the drawings as including two sliding deck members located along the port and starboard sides of the vessel, other embodiments are contemplated where additional sliding deck members are provided along the front and/or rear of the vessel using the same functionality described herein. In such an embodiment, each sliding deck member can be connected along the ends and/or corners to form a continuous expansion deck that completely or partially surrounds the stationary vessel floor 3.

Accordingly, the above described expansion deck system provides a novel solution that greatly increases the useable deck space of a vessel while eliminating tripping hazards so as to allow users full access to the entire expansion deck area.

As described herein, one or more elements of the expansion deck system 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An expansion deck system for a vessel, said system comprising:

an elongated deck member having a top surface, a bottom surface, an inside edge and an outside edge; and a fixed shape frame assembly having a top surface, a bottom surface, a first side with a first elongated opening, and a second side with a second elongated opening, wherein the top surface includes functionality for connecting to a stationary floor of a vessel, and the bottom surface includes functionality for connecting to a pair of pontoons of the vessel, wherein the elongated deck member is telescopically engaged to the frame assembly and is configured to transition between a retracted position and an extended position, and wherein in the retracted position, the elongated deck member is positioned between the top surface and the bottom surface of the frame assembly.

2. The system of claim 1, wherein the frame assembly includes a hollow middle section.

3. The system of claim 2, wherein the elongated deck member is selectively positioned within the hollow middle section of the frame assembly.

4. The system of claim 2, wherein in the retracted position, the elongated deck member is positioned within the hollow middle section of the frame assembly.

5. The system of claim 2, wherein in the extended position, the elongated deck member extends outward from one of the first side or the second side of the frame assembly, and away from each of the stationary floor, and pair of pontoons attached to the frame assembly.

6. The system of claim 2, wherein the frame assembly includes a plurality of braces that extend between the first side and the second side of the frame assembly, and wherein the frame assembly is configured to be positioned between a stationary floor of a vessel and a plurality of pontoons of the vessel.

7. The system of claim 1, further comprising:

at least one sliding rail member that is in communication with each of the frame assembly and the elongated deck member.

8. The system of claim 7, wherein each of the at least one sliding rail member includes functionality for selectively moving the elongated deck member linearly between the retracted position and the extended position.

9. The system of claim 8, wherein in the retracted position, a major axis of the elongated deck member is aligned vertically parallel with a major axis of the frame assembly.

10. The system of claim 9, wherein in the extended position, a major axis of the elongated deck member is aligned horizontally parallel with the major axis of the frame assembly.

11. The system of claim 1, further comprising:

a linear motor that is in communication with the elongated deck member, said linear motor being configured to move the elongated deck member between the retracted position and the extended position.

12. The system of claim 1, further comprising:

a second elongated deck member that is telescopically engaged to the frame assembly, and is configured to transition between the retracted position and the extended position.

13. The system of claim 12, further comprising:

at least one linear motor that is in communication with each of the elongated deck member, and the second elongated deck member, each of the at least one linear motors being configured to move at least one of the elongated deck member and the second elongated deck member between the retracted position and the extended positions.

14. A vessel, comprising:

a plurality of pontoon floats;

a stationary floor;

a fixed shape frame assembly having a top surface, and a bottom surface, said frame assembly being positioned between each of the plurality of pontoon floats and the stationary floor; and an elongated deck member that is telescopically engaged to the frame assembly at a location between the top surface of the frame and the bottom surface of the frame, said elongated deck member being configured to transition between a retracted position and an extended position relative to a stationary orientation of each of the plurality of pontoon floats and the stationary floor.

15. The vessel of claim 14, wherein the frame assembly includes a first side with a first elongated opening, a second side with a second elongated opening, and a hollow middle section, said first elongated opening, second elongated opening and hollow middle section being positioned between the top surface and bottom surface.

16. The vessel of claim 15, wherein the elongated deck member is selectively positioned within the hollow middle section of the frame assembly.

17. The vessel of claim 15, wherein in the retracted position, the elongated deck member is positioned within the hollow middle section of the frame assembly.

18. The vessel of claim 15, wherein in the extended position, the elongated deck member extends outward from one of the first side or the second side of the frame assembly, and away from each of the stationary floor, and pair of pontoons attached to the frame assembly.

19. The vessel of claim 15, further comprising:

a second elongated deck member that is telescopically engaged to the frame assembly, and is configured to transition between the retracted position and the extended position.

20. The vessel of claim 19, wherein in the retracted position, each of the elongated deck member and the second elongated deck member are positioned within the hollow middle section of the frame assembly, and in the extended position, each of the elongated deck member and the second elongated deck member extend outward from one of the first side or the second side of the frame assembly, and away from each of the stationary floor, and pair of pontoons attached to the frame assembly.

* * * * *